United States Patent [19]

Eckhardt et al.

[11] 3,942,321

[45] Mar. 9, 1976

[54] ENGINE SECONDARY AIR CONTROL VALVE

[75] Inventors: Dennis C. Eckhardt; Michael A. Dunlap, both of Saginaw; Robert A. Hoppe, Bridgeport, all of Mich.

[73] Assignee: General Motors Corporation, Detroit, Mich.

[22] Filed: Feb. 11, 1975

[21] Appl. No.: 548,970

[52] U.S. Cl. ..... 60/289; 60/307

[51] Int. Cl.[2] ..... F02B 75/10

[58] Field of Search ..... 60/289, 307, 290

[56] References Cited

UNITED STATES PATENTS

| | | | |
|---|---|---|---|
| 3,796,049 | 3/1974 | Hayashi | 60/290 |
| 3,818,702 | 6/1974 | Woo | 60/307 |

*Primary Examiner*—Douglas Hart
*Attorney, Agent, or Firm*—Robert M. Sigler

[57] ABSTRACT

A valve for distributing secondary air from an engine driven pump between the engine exhaust conduit and an accessory device has a valve chamber with an inlet from the air pump and an outlet to the exhaust conduit and a pressure chamber with an outlet to the accessory device and a movable wall biased inward by a spring. A fixed wall between the valve and pressure chambers has a central opening and peripheral openings. A shaft fixed to the movable wall extends through the central opening into the valve chamber and has a valve member on its end for opening and closing the valve chamber outlet. A flexible annular sealing valve member has an inner circular bead sealingly engaging a groove in the shaft, an outer circumferential groove sealingly engaging the periphery of the central opening and an outer peripheral flap valve portion covering the peripheral openings within the pressure chamber to act as a check valve for allowing air flow only from the valve chamber to the pressure chamber. The movable wall, spring, valve member and check valve combine to maintain secondary air pressure at a minimum or greater pressure.

1 Claim, 3 Drawing Figures

ENGINE SECONDARY AIR CONTROL VALVE

BACKGROUND OF THE INVENTION

Small engine accessory devices not directly driven by an engine, and especially such intermittently operated devices as automatically controlled valves and switches for vehicle air conditioning or emission control systems, are generally actuated by carburetor manifold vacuum. However, the use of engines without carburetors or with widely varying manifold vacuum levels suggests the use of some other source of power for actuation of these accessory devices. Engines equipped with an engine driven air pump providing secondary air flow for exhaust emission control purposes already have a source of air at positive pressure which is available for intermittent use.

SUMMARY OF THE INVENTION

This invention is a valve for distributing secondary air from an air pump between an engine exhaust system and at least one engine accessory device. A particular feature of this valve is that it maintains the secondary air supply to the accessory device at a minimum or greater pressure, providing that the air pump itself supplies air at that minimum pressure. The valve employs a novel construction to be described in the specification and particularly including a flexible annular sealing valve member which coacts with openings in a wall between two chambers to form a seal around a shaft passing through one of the openings and form a check valve with the other openings to allow air flow in only one direction between the chambers.

Further details and advantages of this invention will be apparent from the accompanying drawings and following description of a preferred embodiment.

DESCRIPTION OF A PREFERRED EMBODIMENT

Figure 1:
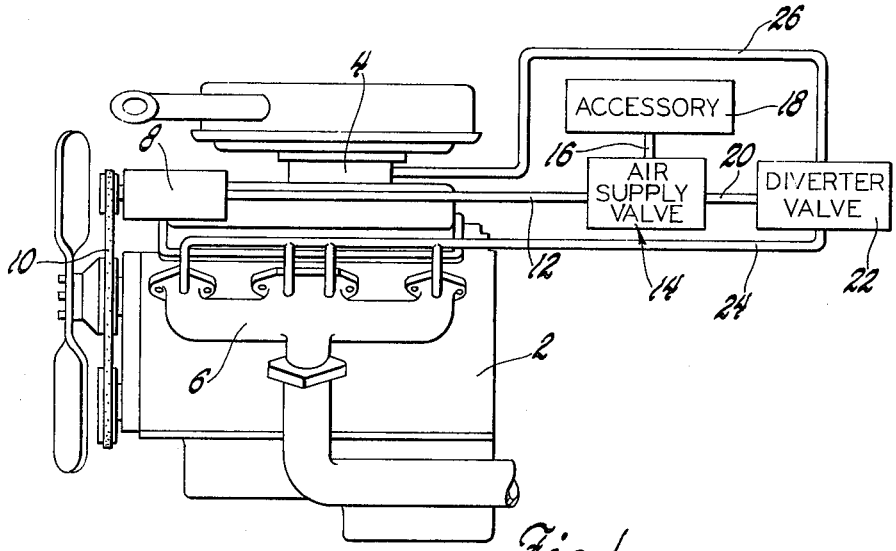
FIG. 1 is a schematic diagram showing a valve of this invention in its environment.

Referring to FIG. 1, an engine 2 receives air and fuel through a carburetor 4 and discharges exhaust gases through an exhaust conduit 6. Engine 2 drives an air pump 8 through a belt 10; and the output of air pump 8 is supplied through a conduit 12 to an air supply valve 14, which is the valve of this invention.

Air supply valve 14 distributes air either through conduit 16 to an accessory 18, which is representative of all the air actuated accessories, or through a conduit 20 to diverter valve 22. Diverter valve 22 is a standard device for supplying air through a conduit 24 to exhaust conduit 6 or dumping the air to atmosphere, according to a manifold vacuum signal received from carburetor 4 through conduit 26.

Figure 2:
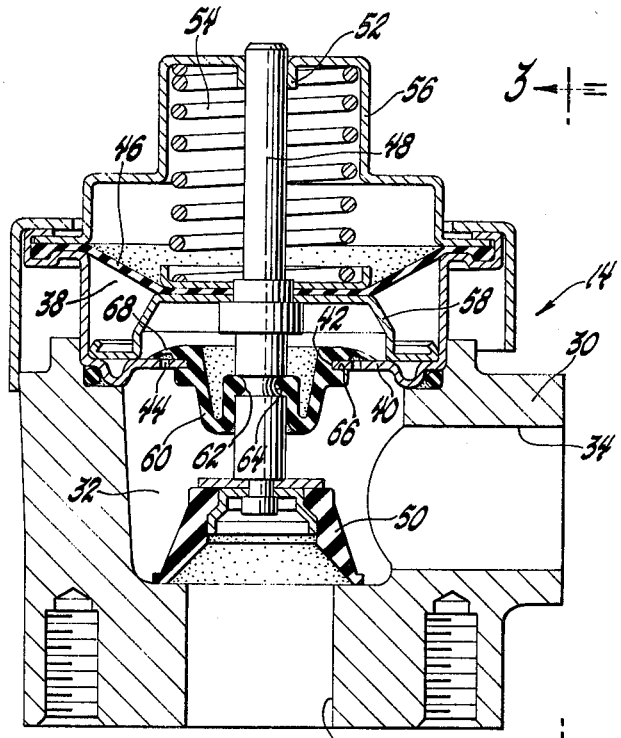
FIG. 2 is a cutaway view of a valve according to this invention.
Figure 3:
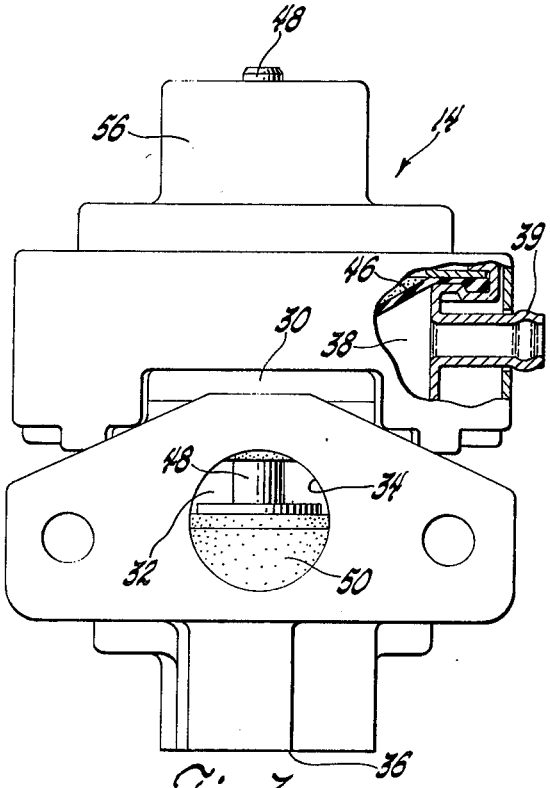
FIG. 3 is a view along lines 3—3 in FIG. 2, the view being partially cut away to show an internal detail of construction.

Referring to FIGS. 2 and 3, valve 14 has a housing 30 defining a valve chamber 32 with an inlet 34 for connection to air pump 8 and an outlet 36 for connection to diverter valve 22 and communication therethrough to exhaust conduit 6. In actual practice as shown in FIG. 2, valve 14 is designed to be attached directly to air pump 8 and diverter valve 22 with resultant elimination of separate conduits 12 and 20.

Housing 30 further defines a pressure chamber 38 and an outlet tube 39 forming an outlet from pressure chamber 38 to be connected through conduit 16 to accessory 18. Pressure chamber 38 is separated from valve chamber 30 by a fixed wall 40 having a central opening 42 and one or more peripheral openings 44. Fixed wall 40 forms the side of valve chamber 32 directly opposite valve chamber outlet 36, and central opening 42 is axially aligned with outlet 36. A movable wall such as flexible diaphragm 46 forms the wall of pressure chamber 38 directly opposite fixed wall 40. A shaft 48 has a valve member 50 at one end within valve chamber 32 adjacent valve chamber outlet 36 and another end in a shaft guide 52 on the opposite side of diaphragm 46. Shaft 48 extends through central opening 42, is axially aligned with valve chamber outlet 36 and is fixed to diaphragm 46 for axial co-movement therewith.

A spring 54 in a cup portion 56 of housing 30 biases diaphragm 46 toward fixed wall 40 and shaft 48 with valve member 50 toward valve chamber outlet 36. A cup shaped stop member 58 limits movement of diaphragm 46 and shaft 48 in this direction to maintain a minimum force on diaphragm 46 in this direction while limiting the load on valve member 50 as it closes valve chamber outlet 36.

A flexible annular sealing valve member 60 completes the separation of valve chamber 32 from pressure chamber 38. Flexible member 60 has a central circumferential bead 62 sealingly engaging a circumferential groove 64 in shaft 48 and an outer peripheral groove 66 which sealingly engages the periphery of central opening 42. A peripheral flexible flap portion 68 of member 60 extends along the pressure chamber 38 side of fixed wall 40 to cover peripheral openings 44. Flap portion 68 is preferably in the form of a single outer peripheral flap but can also assume the form of a plurality of separate flaps for multiple openings. Flap portion 68 is normally slightly self-biased against fixed wall 40 to form a check valve to allow air flow through peripheral openings 44 only from valve chamber 32 to pressure chamber 38.

In operation, air enters valve chamber 32 through inlet 34 from air pump 8. If valve member 50 is pulled away from outlet 36, the air is able to flow out through outlet 36 to diverter valve 22. If the air pressure within valve chamber 32 exceeds that within pressure chamber 38, some air flows through peripheral openings 44 and past flap portion 68 into pressure chamber 38. The pressure within pressure chamber 38, acting over the total surface of flexible diaphragm 46 generates an upward force on diaphragm 46 and shaft 48 which is opposed by a downward force exerted by spring 54. Spring 54 is installed so that it is compressed even when stop 58 engages fixed wall 40 so that valve member 50 will close valve chamber outlet 36 for all pressures within pressure chamber 38 less than a certain desired minimum pressure. For pressures within pressure chamber 38 greater than the minimum pressure, diaphragm 46 moves upward until it is balanced between the air pressure within chamber 38 and the force of spring 54 and thus valve member 50 is pulled away from valve chamber outlet 36 to open outlet 36. Flap portion 68 of flexible member 60 prevents air from leaking back from pressure chamber 38 to valve chamber 32 when the pressure in pressure chamber 38 is higher.

Thus, as long as the pressure of air in pressure chamber 38 is equal to or greater than the minimum desired secondary air pressure for accessory 18, the air will be retained within pressure chamber 38 for the actuation of accessory 18, and flexible diaphragm 46 and shaft 48 will pull valve member 50 away from valve chamber outlet 36 to allow air flow from pump 8 to diverter valve 22. However, whenever air pressure within pressure chamber 38 drops below the minimum desired level, valve member 50 closes outlet 36 long enough for the resultant increase of air pressure within valve chamber 32 to cause air to flow through peripheral openings 40 into pressure chamber 38 and increase the air pressure therein to the desired minimum.

The described embodiment of this invention is a preferred embodiment, but not the only embodiment that will occur to those skilled in the art. Therefore, the invention should be limited only by the claim which follows.

The embodiments of the invention in which an exclusive property or privilege is claimed are defined as follows:

1. A valve for distributing secondary air from an engine driven pump between an engine exhaust conduit for emission control and at least one accessory device for actuation thereof and further for maintaining a minimum or greater pressure in the air supplied to the accessory device, the valve comprising a housing defining a valve chamber with an inlet from the air pump and an outlet to the exhaust conduit and a pressure chamber having an outlet to the accessory device; a fixed wall separating the valve and pressure chambers, the fixed wall having a central opening and one or more peripheral openings opposite the valve chamber outlet; a movable wall forming one side of the pressure chamber; a shaft fixed to the movable wall for co-movement therewith, the shaft having one end projecting through the fixed wall central opening into the valve chamber adjacent the valve chamber outlet and a circumferential groove; a valve member on the one end of the shaft, the valve member being effective to open and close the valve chamber outlet with movement of the movable wall away from and toward, respectively, the fixed wall; a spring in the housing, the spring biasing the movable wall toward the fixed wall in opposition to the pressure of air within the pressure chamber, the valve member closing and opening the valve chamber with pressure chamber air pressure less than and greater than, respectively, the secondary air minimum pressure; and a flexible annular sealing valve member having a central circumferential bead sealingly engaging the shaft circumferential groove, an outer peripheral groove sealingly engaging the periphery of the fixed wall central opening, and at least one flexible flap portion covering the fixed wall peripheral openings within the pressure chamber and being effective to act as a check valve for allowing air flow only from the valve chamber to the pressure chamber, which air flow maintains the pressure chamber air pressure at or above the secondary air minimum pressure.

* * * * *